United States Patent [19]

Heyne et al.

[11] Patent Number: 4,534,263

[45] Date of Patent: Aug. 13, 1985

[54] ELECTROMAGNETIC LAUNCHER WITH HIGH REPETITION RATE SWITCH

[75] Inventors: Carl J. Heyne, Hampton Township, Allegheny County; Daniel W. Deis, Churchill Borough, both of Pa.

[73] Assignee: Westinghouse Electric Corp., Pittsburgh, Pa.

[21] Appl. No.: 399,510

[22] Filed: Jul. 19, 1982

[51] Int. Cl.[3] ..... F41F 1/02; H02K 41/02; H01H 85/18

[52] U.S. Cl. ..... 89/8; 124/3; 200/8 A; 200/151; 310/13

[58] Field of Search ..... 89/8, 194, 195; 124/3; 310/10, 12, 13; 200/8 A, 151; 376/100, 108; 318/135

[56] References Cited

U.S. PATENT DOCUMENTS

| | | | |
|---|---|---|---|
| 2,870,675 | 1/1959 | Salisbury | 89/8 X |
| 3,126,789 | 3/1964 | Meyer | 89/8 |
| 3,878,409 | 4/1975 | Gill et al. | 89/8 X |
| 4,319,168 | 3/1982 | Kemeny | 124/3 X |
| 4,329,971 | 5/1982 | Kemeny et al. | 124/3 |
| 4,342,978 | 8/1982 | Meister | 200/151 X |
| 4,347,463 | 8/1982 | Kemeny et al. | 89/8 X |
| 4,355,561 | 10/1982 | Kemeny et al. | 89/8 |
| 4,369,692 | 1/1983 | Kemeny | 89/8 |
| 4,426,562 | 1/1984 | Kemeny | 200/8 A X |
| 4,433,607 | 2/1984 | Kemeny | 89/8 |

*Primary Examiner*—David H. Brown
*Assistant Examiner*—John E. Griffiths
*Attorney, Agent, or Firm*—Robert P. Lenart

[57] ABSTRACT

An electromagnetic projectile launcher is provided with a cartridge-type switch for commutating current from a high current source to a pair of generally parallel conductive rails. A conductive cartridge switch in sliding electrical contact with the rails at the breech end includes a pressure chamber and aperture for receiving a projectile. An increase in pressure in the pressure chamber forces the projectile forward while forcing the cartridge rearward. Current is commutated from the cartridge to a conductive armature which subsequently propels a projectile along the conductive rails.

23 Claims, 6 Drawing Figures

ELECTROMAGNETIC LAUNCHER WITH HIGH REPETITION RATE SWITCH

BACKGROUND OF THE INVENTION

This invention relates to electromagnetic projectile launchers and, more particularly, to such launchers that include a switching device which provides for a rapid repetition rate for successive launches.

Electromagnetic projectile launchers are capable of accelerating various types of projectiles to high velocities. Several possible applications of electromagnetic launchers, such as fusion reactor pellet injection, impact fusion and weapons, require that the launcher accelerate a projectile to very high velocities and have a rapid repetition rate for successive shots.

Electromagnetic projectile launchers are known which comprise a pair of generally parallel conductive rails, a sliding conductive armature between the rails, a source of high current, and a switch for commutating this current into the rails and through the armature. Current flowing in the armature produces a force which accelerates a projectile along the projectile rails. Several different projectile configurations have been proposed, however, the projectiles are usually provided with a metallic armature or a plasma armature. The metallic armature projectile has a conducting member on its base which conducts current from one projectile rail to the other by using a sliding contact. These armatures are generally made of a flexible, brush-type conducting material which is forced against the projectile rails by electromagnetic forces which ultimately propel the projectile. The plasma armature projectile utilizes an electric arc for the conduction path. By providing a tight seal between the projectile and bore, the plasma cannot blow pass the projectile and therefore transfers the electromagnetic forces acting on it to the projectile. Plasma drive offers the advantage of being very low in mass, so that substantially all of the energy for acceleration goes into the launcher payload. However, a slow moving plasma can cause rail damage during the initial stage of projectile acceleration. The present invention concerns a novel switch for commutating the high current into the projectile launching rails. This switch allows for a high repetition rate and rapid projectile reloading. It also imparts an initial velocity to the projectile.

Several configurations for the commutating switch have been proposed where the switch performs the functions of conducting current during an initial charging sequence and commutating current into the projectile rails during the firing sequence. These schemes have consisted primarily of a switching armature which conducts current during the charging sequence and then is propelled using electromagnetic forces across an insulating surface to commutate current into the projectile rails and the projectile armature. Switching armature schemes generally incorporate a shock absorber system to allow recovery of the switching armature. Switching armatures have been proposed for use in launchers which utilize both a metallic armature and a plasma armature. The switching armature scheme relies on rapid movement of the switch to commutate current into the armature and reloading of the launcher must be accomplished before another launch is initiated. In addition, repeated usage of the switching armature will result in armature deterioration from the effect of the commutating arc.

A rotary type commutating switch has been proposed to allow for an increased repetition rate. Various geometries of insulating and conducting sections of a rotating wheel which contact stationary current collecting members have been proposed. Rotation of the wheel switches current from the stationary current collecting members to the projectile rails.

Regardless of the type of commutating switch used, severe rail damage can occur during the initial acceleration of a projectile in the launcher bore. This damage can be reduced to manageable levels by proper projectile armature design and by imparting the projectile with an initial velocity which is high enough to reduce the energy density on the rails in the breech of the launcher.

Neither the switching armature nor the rotary switch provides a method of firing an electromagnetic launcher at high repetition rates for sustained periods. Rapid fire capabilities require that a method be devised for rapidly loading the projectile, imparting an initial velocity to the projectile, rapidly commutating current to the rails and initiating a plasma drive if needed. In addition, the switch must be such that sustained firing will not degrade it.

SUMMARY OF THE INVENTION

An electromagnetic projectile launcher constructed in accordance with the present invention comprises: a pair of generally parallel conductive rails, forming a bore having a breech end and a muzzle end; a source of high current connected to the rails; a conductive switch cartridge in sliding electrical contact with the rails at the breech end, with the cartridge having a pressure chamber and an aperture for receiving a projectile; means for increasing pressure within the pressure chamber to accelerate the projectile along the cartridge and to remove the cartridge from electrical contact with the rails; and means for conducting current between the rails after the cartridge is removed from electrical contact with the rails. The means for increasing pressure within the pressure chamber can be a combustible material located within the chamber which is provided with a suitable ignition device. Once the cartridge has been removed from electrical contact with the rails, current can be conducted between the rails by a metallic armature or a plasma armature. In the case of a plasma armature, the plasma may have been generated as a result of the combustion of the combustible material.

A switch for conducting current between two conductive rails of an electromagnetic launcher and for commutating current to a conductive armature between the rails, in accordance with this invention comprises: a conductive cartridge having a pressure chamber and an aperture for receiving a projectile; means for increasing pressure within the pressure chamber to accelerate the projectile toward a muzzle end of the rails and to accelerate the cartridge in the opposite direction; and means for conducting current between the rails and for propelling the projectile along the rails after the cartridge is removed from electrical contact with the rails. The means for conducting current between the rails may be a conductive metallic armature which is initially located within the pressure chamber but electrically insulated from the cartridge, or alternatively, it can be a plasma armature which is created by combustion within the pressure chamber.

Regardless of the type of armature used, the switch operation is in accordance with a method of commutating current from a pair of conductive rails into a conductive armature comprising the steps of: placing a conductive cartridge in electrical contact with the conductive rails, said cartridge having a pressure chamber and an aperture for receiving a projectile; causing current to flow through the rails and the cartridge; creating pressure within the pressure chamber to accelerate the projectile toward a muzzle end of the conductive rails; establishing an armature current path between the rails; and breaking electrical contact between the cartridge and the rails.

DESCRIPTION OF THE PREFERRED EMBODIMENT

Figure 1:
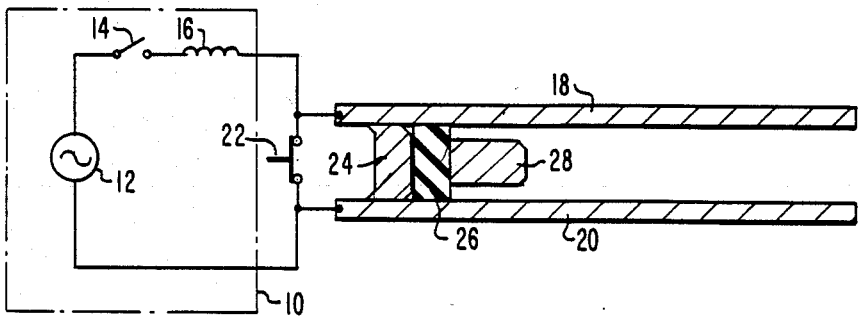
FIG. 1 PRIOR ART
FIG. 1 is a schematic drawing of a prior art electromagnetic projectile launcher.

Referring to the drawings, FIG. 1 is a schematic drawing of a prior art electromagnetic projectile launcher. In this launcher, a source of high current 10 comprising the series connection of direct current generator 12, switch 14 and inductor 16, is connected to a pair of generally parallel conductive rails 18 and 20. Switch 22 is connected across the breech end of conductive rails 18 and 20, and provides a means for commutating current from high current source 10 to rails 18 and 20. Armature 24, which serves as means for conducting current between rails 18 and 20, is connected to an optional insulating sabot 26 and projectile 28. Armature 24 may be a metallic sliding armature or a plasma. If a plasma armature is used, insulating sabot 26 serves to seal the bore between rails 18 and 20, thereby preventing leakage of the plasma around projectile 28. Alternatively, projectile 28 may be sized to seal the bore. During a firing sequence, switches 14 and 22 are initially closed to provide for current flow through inductor 16. When a predetermined current has been reached in inductor 16, corresponding to a desired energy level, switch 22 is opened thereby commutating the current from current source 10 into rails 18 and 20 and through armature 24. This current flowing through the rails and armature produces a force on the armature which propels the projectile along the rails.

Figure 2:
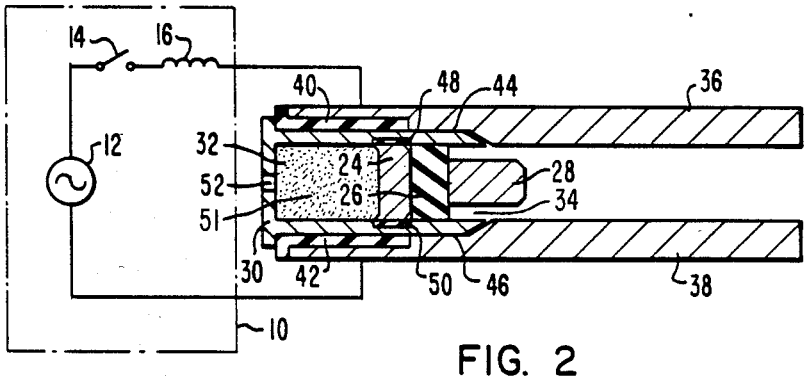
FIG. 2 is a schematic of an electromagnetic projectile launcher constructed in accordance with one embodiment of the present invention.

FIG. 2 shows an electromagnetic projectile launcher in accordance with one embodiment of the present invention. In FIG. 2, commutating switch 22 of FIG. 1 has been replaced by a cartridge-type commutating switch. Switch cartridge 30 is constructed of a conductive material and provided with a pressure chamber 32 and an aperture 34 for receiving a projectile assembly. Cartridge 30 is inserted in sliding contact between a pair of generally parallel conductive rails 36 and 38. Insulation 40 and 42 is disposed along the inner surface of conductive rails 36 and 38 respectively at the breech end. This insulation has a length less than the length of cartridge 30, thereby allowing electrical contact between cartridge 30 and rails 36 and 38 at surfaces 44 and 46, respectively. Since the projectile assembly in this embodiment is shown with a metallic armature 24, insulation 48 and 50 is disposed along the inner surface of cartridge 30 in order to prevent premature current flow through armature 24. Pressure chamber 32 may be filled with a combustible material 51 which is ignited by igniter 52 at the beginning of the launch sequence. Optional insulation sabot 26 serves to position projectile 28 and can act to seal the bore if a plasma armature is used.

The operating sequence of the electromagnetic projectile launcher of FIG. 2 is as follows:

1. Cartridge 30, with projectile 28, optional sabot 26 and armature 24, is loaded into sliding contact with the breech area of launcher rails 36 and 38.

2. Switch 14 is closed, to allow for the charging of inductor 16. Current flows from generator 12, through inductor 16, rail 36, cartridge 30 and rail 38, and back to generator 12 to complete the circuit. Insulating surfaces 48 and 50, prevent current flow in armature 24 to prevent premature launching.

3. When the inductive energy stored in inductor 16 has reached a desired level, an electical signal may be used to trigger ignition device 52 which ignites combustible material 51 in pressure chamber 32.

4. The pressure in chamber 32 causes the projectile assembly to begin moving toward the lauching rails while simultaneously driving cartridge 30 toward the rear.

5. The curent flowing through cartridge 30 begins to flow into armature 24 as the armature leaves insulating surfaces 48 and 50 and contacts the metallic portion of cartridge 30.

6. The projectile continues to move forward into conductive rails 36 and 38 while cartridge 30 moves to the rear. When cartridge 30 moves far enough to the rear, insulation 40 and 42 at the breech end of conductive rails 36 and 38, stops current flow in the cartridge 30 and commutates all current into armature 24.

Figure 6:
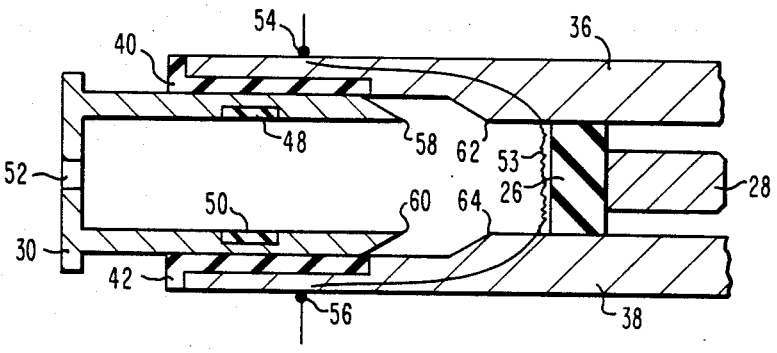
FIG. 6 is an enlarged view of the breech section of an alternative embodiment of the present invention in which a plasma armature is shown to conduct current between the projectile launching rails.

7. The pressure in pressure chamber 32 imparts an initial velocity to the projectile which reduces rail erosion. The amount of pressure required in a launch can be determined as that necessary to produce a desired minimum initial projectile velocity to reduce rail damage to an acceptable level. In addition, combustion of the combustible material 51 in chamber 32 can produce a plasma, 53 in FIG. 6 which acts as an armature for a plasma armature projectile.

8. The energy contained in the rearward motion of cartridge 30 can be harnessed to operate a reloading mechanism which inserts a new projectile/cartridge assembly into sliding contact with rails 36 and 38. Alternatively, the pressure produced in the cartridge can actuate a piston which triggers a cartridge ejection/-loading mechanism. The reloading mechanism can be similar to that of a conventional repeating firearm.

Figure 3:
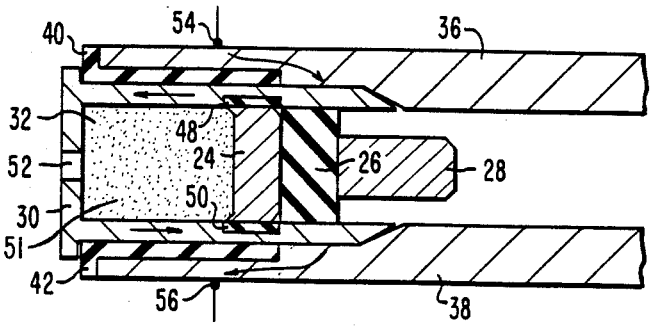
FIGS. 3, 4 and 5 are enlarged views of the breech section of the laucher of FIG. 2, showing the relative position of the rails and switch cartridge during various stages of the launch sequence.
Figure 4:
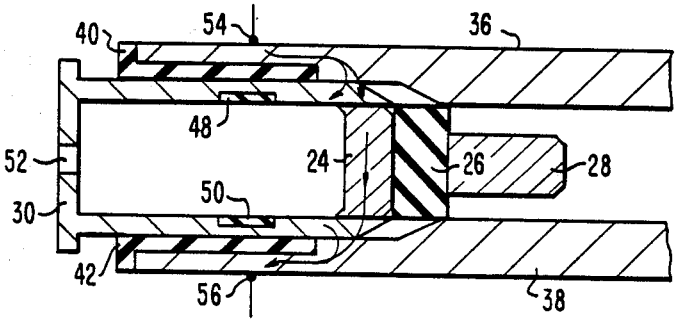
Figure 5:
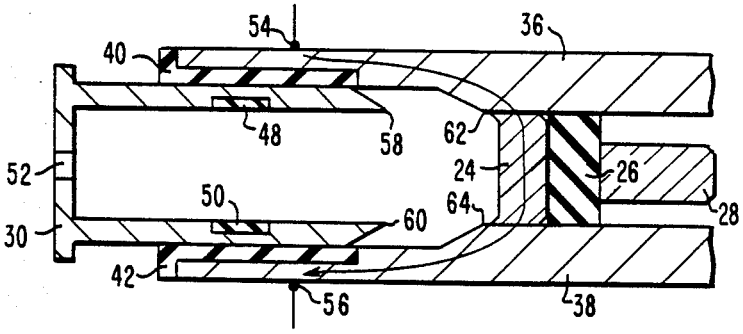

FIGS. 3, 4 and 5 illustrate the breech section of the launcher of FIG. 2 during various stages of a launch sequence. FIG. 3 shows the launcher in its charged or ready-to-launch mode. The charging current from supply 10 flows from the connection 54 with launcher rail 36, through the body of cartridge 30, to the connection 56 with launcher rail 38, as illustrated by an arrow in the drawings. Insulation 48 and 50 prevents the current from passing through projectile armature 24 which would cause a premature launch. At an appropriate time, ignition device 52 would be triggered thereby causing combustion in chamber 32 and creating a pressure within the chamber.

Referring to FIG. 4, the pressure created in chamber 32 produces a force which simultaneously accelerates projectile 28 and cartridge 30. In a plasma armature is to be used, the combustion of material in chamber 32 can produce a plasma armature which will eventually serve to conduct current between rails 36 and 38. As cartridge 30 begins to move toward the rear, current begins to divide and flows through cartridge 30 as well as through projectile armature 24. Current division is caused by contact of armature 24 with the metallic portion of cartridge 30, coupled with the rearward motion of cartridge 30. This rearward motion crowds the current at the front edge of rail insulation 40 and 42 begins to produce a communication voltage.

FIG. 5 shows the position of cartridge 30 and projectile 28 as cartridge 30 moves behind rail insulation 40 and 42. This insulation prevents current from flowing through the cartridge and forces all current to commutate into projectile rails 36 and 38 and armature 24. The cartridge 30 and projectile 28 both can attain sufficient velocity to prevent rail damage during this commutation phase of operation. The geometry of the switching device aids the commutation process since current is not being forced into a different path, but rather the switch cartridge slides away from the preferred current path while the projectile armature replaces it.

If a plasma armature is used, bore sealing sabot 26 must be constructed to insure that the plasma cannot leak in front of projectile 28. This can be accomplished by making sabot 26 of sufficient width such that before the trailing edge of sabot 26 passes the end points 58 and 60 of cartridge 30, the leading edge of sabot 26 has passed points 62 and 64 on rails 36 and 38 respectively. This will eliminate the possibility of plasma leakage around sabot 26. Alternatively, projectile 28 can be sized to perform this bore sealing function.

As projectile 28 is accelerated along rails 36 and 38, switch cartridge 30 continues to the rear and is ejected from the breech of the launcher. This rearward motion or the pressure from the pressure chamber can be used to charge a mechanism which will automatically load a fresh cartridge and projectile into the launcher rails. Loading of the new cartridge will allow the cycle to be repeated.

It can be seen that an electromagnetic projectile launcher in accordance with the present invention is suitable for lauching projectiles at a rapid repetition rate. Since a sacrificial switch cartridge can be used, the launcher switch assembly can operate continuously at a high repetition rate. Combustion within the pressure chamber of the cartridge imparts an initial velocity to the projectile to prevent rail damage, and can serve to initiate a plasma where a plasma armature is desired. The use of a pressure chamber will significantly increase the velocity of a projectile by using this pressure to augment the electromagnetic forces of the launcher.

The use of a cartridge-type switch provides a compact, simple and proven method of reloading a rapidly fired system. It also provides for a method of rapidly commutating current into a projectile armature with minimum system erosion. Known repeating weapon reloading mechanisms can be adapted to the launcher to provide the reloading function.

Although a particular embodiment of the present invention has been described in detail, it will be apparent to those skilled in the art that various modifications may be made without departing from the scope of this invention. For example, various types of pressure-producing materials can be utilized in the cartridge pressure chamber such as fuse wires, conventional combustible material, non-combustion chemical reactions, etc. It is therefore intended that the appended claims cover all such changes that fall within the scope of the invention.

We claim:

1. A switch for conducting current between two conductive rails and for commutating said current into a conductive armature between said rails, said switch comprising:

a conductive cartridge shaped to make sliding electrical contact with said rails, said cartridge having a pressure chamber and an aperture for receiving a projectile;

means for increasing pressure within said pressure chamber to accelerate said projectile toward a muzzle end of said rails and to accelerate said cartridge in the opposite direction; and means for conducting current between said rails and for propelling said projectile along said rails.

2. A switch as recited in claim 1, wherein said means for conducting current between said rails and for propelling said projectile comprises a plasma.

3. A switch as recited in claim 1, wherein said means for conducting current between said rails and for propelling said projectile comprises a metallic conductive element.

4. A switch for conducting current between two conductive rails and for commutating said current into a conductive armature between said rails, said switch comprising:

a conductive cartridge shaped to make sliding electrical contact with said rails;

said cartridge having a pressure chamber and an aperture for receiving a projectile;

said conductive armature being initially located within said pressure chamber;

means for increasing pressure within said pressure chamber to accelerate said conductive armature out of said cartridge and to accelerate said cartridge in the opposite direction, thereby breaking electrical contact between said cartridge and said conductive rails; and means for preventing current flow through said conductive armature prior to the acceleration of said armature caused by increasing pressure within said pressure chamber.

5. A switch as recited in claim 4, wherein said means for increasing pressure comprises:

a combustible material within said pressure chamber; and means for igniting said combustible material.

6. A switch as recited in claim 4, wherein said means for preventing current flow comprises:

insulation disposed within said pressure chamber.

7. A switch as recited in claim 6, wherein said insulation is spaced from said aperture, allowing electrical contact between said cartridge and said conductive armature prior to said armature's exit from said cartridge.

8. A switch for conducting current between two conductive rails and for commutating said current into a plasma between said rails, said switch comprising:

a conductive cartridge shaped to make sliding electrical contact with said rails;

said cartridge having a pressure chamber and an aperture for receiving a projectile;

means for increasing pressure within said pressure chamber to accelerate said projectile away from said cartridge and to accelerate said cartridge in the opposite direction, thereby breaking electrical contact between said cartridge and said conductive rails; and said means for increasing pressure also serving as means for generating a plasma to conduct current between said rails following the breaking of electrical contact between said rails and said cartridge.

9. A switch as recited in claim 8, wherein said means for increasing pressure comprises:

a combustible material within said pressure chamber; and means for igniting said combustible material.

10. An electromagnetic projectile launcher comprising:

a pair of generally parallel conductive rails, said rails forming a bore having a breech end and a muzzle end;

a source of current, connected to said rails;

a conductive switch cartridge in sliding electrical contact with said rails at the breech end, said cartridge; having a pressure chamber and an aperture for receiving a projectile;

means for increasing pressure within said pressure chamber to accelerate said projectile along said cartridge and to remove said cartridge from electrical contact with said rails; and means for conducting current between said rails after said cartridge is removed from electrical contact with said rails.

11. An electromagnetic launcher as recited in claim 10, further comprising:

electrical insulation disposed along the bore side of said rails, said insulation extending from the breech end of said rails and having a length less than the length of said cartridge.

12. An electromagnetic launcher as recited in claim 10, wherein the pressure created by said means for increasing pressure is sufficient to accelerate said projectile to a preselected velocity prior to the removal of said cartridge from electrical contact with said rails.

13. An electromagnetic launcher as recited in claim 10, wherein said means for increasing pressure comprises:

a combustible material within said pressure chamber; and means for igniting said combustible material.

14. An electromagnetic launcher as recited in claim 13, wherein combustion of said combustible material forms a plasma; and said means for conducting current comprises said plasma.

15. An electromagnetic launcher as recited in claim 10, wherein said means for conducting current is a plasma.

16. An electromagnetic launcher as recited in claim 15, further comprising:

means for sealing said bore to prevent leakage of said plasma past said projectile.

17. An electromagnetic launcher as recited in claim 16, wherein said means for sealing is an insulating sabot.

18. An electromagnetic launcher as recited in claim 10, wherein said means for conducting current is a conductive armature.

19. An electromagnetic launcher as recited in claim 18, further comprising:

means for preventing current flow through said conductive armature prior to the acceleration of said projectile, within said cartridge, caused by increasing pressure within said pressure chamber.

20. An electromagnetic launcher as recited in claim 19, wherein said means for preventing current flow comprises:

insulation disposed along a portion of an inner surface of said cartridge.

21. A method of commutating current from a pair of conductive rails into an armature between the rails, comprising the steps of:

placing a conductive cartridge in electrical contact with said conductive rails, said cartridge having a pressure chamber and an aperture for receiving a projectile;

causing current to flow through said rails and said cartridge;

creating pressure within said pressure chamber to accelerate said projectile toward a muzzle end of said conductive rails;

establishing an armature current path between said rails; and breaking electrical contact between said cartridge and said rails.

22. A method of commutating current from a pair of conductive rails into a plasma armature between the rails, comprising the steps of:

placing a conductive cartridge in electrical contact with said conductive rails, said cartridge having a pressure chamber and an aperture for receiving a projectile;

causing current to flow through said rails and through said cartridge;

creating pressure within said pressure chamber to accelerate said projectile toward a muzzle end of said conductive rails and to accelerate said cartridge in the opposite direction;

creating a plasma between said rails for conducting current between said rails; and breaking electrical contact between said switch cartridge and said rails.

23. A method of commutating current from a pair of conductive rails into a conductive armature between the rails, comprising the steps of:

placing said conductive armature into a pressure chamber of a conductive cartridge;

insulating said conductive armature from said cartridge;

placing said conductive cartridge in electrical contact with said rails;

causing current to flow through said rails and through said cartridge;

creating pressure within said pressure chamber to accelerate said conductive armature and a projectile toward a muzzle end of said conductive rails and to accelerate said cartridge in the opposite direction;

making electrical contact between said conductive armature and said rails after said acceleration of said armature; and breaking electrical contact between said cartridge and said rails following said making electrical contact between said conductive armature and said rails.

* * * * *